US005341998A

United States Patent [19]

Cross

[11] Patent Number: 5,341,998

[45] Date of Patent: Aug. 30, 1994

[54] PIN HUB FOR WIRE REEL

[75] Inventor: Dan A. Cross, Kent, Wash.

[73] Assignee: The Boeing Company, Seattle, Wash.

[21] Appl. No.: 162,534

[22] Filed: Dec. 3, 1993

Related U.S. Application Data

[63] Continuation-in-part of Ser. No. 892,275, Jun. 2, 1992, abandoned.

[51] Int. Cl.[5] ..... B65H 79/00

[52] U.S. Cl. ..... 242/47; 242/25 R

[58] Field of Search ..... 242/25 R, 47, 18 R, 242/50, 78, 81, 85, 110, 110.1, 129, 129.5, 129.7, 46.2

[56] References Cited

U.S. PATENT DOCUMENTS

| | | | |
|---|---|---|---|
| 329,053 | 10/1885 | Kizer et al. . | |
| 533,312 | 1/1895 | McCombs . | |
| 994,044 | 5/1911 | Uebelmesser . | |
| 1,264,918 | 5/1918 | Green . | |
| 1,531,147 | 3/1925 | Smith . | |
| 1,896,741 | 2/1933 | Crandall . | |
| 1,950,492 | 3/1934 | Holmes, Jr. | 242/110 |
| 3,041,005 | 6/1962 | Wallace | 242/116 |
| 3,326,495 | 6/1967 | De Bruyn | 242/129 |
| 3,704,839 | 12/1972 | Manoogian | 242/80 |
| 3,727,858 | 4/1973 | Cornwell et al. | 242/129 |
| 3,831,877 | 8/1974 | Bennett et al. | 242/86.5 R |
| 3,957,216 | 5/1976 | Haslau et al. | 242/4 C |
| 4,714,209 | 12/1987 | Allard | 242/25 R |
| 4,715,549 | 12/1987 | Travlos | 242/25 R |
| 4,865,261 | 9/1989 | Bare et al. | 242/47 |

FOREIGN PATENT DOCUMENTS

| | | |
|---|---|---|
| 424482 | 1/1926 | Fed. Rep. of Germany . |
| 1023211 | 3/1953 | France . |
| 1069495 | 7/1954 | France . |

*Primary Examiner*—Stanley N. Gilreath
*Attorney, Agent, or Firm*—Joan H. Pauly

[57] ABSTRACT

The invention disclosed here is a pin hub that is to be used in conjunction with interchangeable wire reels for taking individual wire segments from a continuous wire feed. In use, an empty reel is first mounted to the pin hub. The pin hub has a plurality of pins which are arranged in a circular pattern, and are retracted relative to the hub at the time the reel is mounted. After mounting, the pins are extended through corresponding side openings in the reel, and thereby define a winding hub or circle within the reel itself. Instead of being wound directly against sidewall or hub structure of the reel itself, the wire is instead wound about the pins, and they take up the physical stresses associated with the winding process. After winding is completed, the pins are retracted, and the filled reel is thereafter removed from the pin hub.

8 Claims, 13 Drawing Sheets

10A
12A
14
16
17
18
19
20
22
22A
23
24
24A
26
26A
28
28A
30
30A
32
32A
34
36
38
40
42
44
46
48
50
52
54
78
141
142
140A
162
174
196
198

PIN HUB FOR WIRE REEL

CROSS-REFERENCE TO RELATED APPLICATION

This is a continuation-in-part of application Ser. No. 07/892,275, filed Jun. 2, 1992, now abandoned.

TECHNICAL FIELD

The present invention relates to systems for winding wire segments onto wire reels and, more particularly, to such a system in which wire is wound around a plurality of circumferentially spaced pins that are retractable to permit the reel to be returned to a home position at the end of the winding procedure.

RELATED PATENTS AND PATENT APPLICATIONS

The following patents and/or patent applications are related to the subject matter of the present invention: U.S. application Ser. No. 590,650, filed Sept. 28, 1990, for a "Wire Harness Manufacturing System", now U.S. Pat. No. 5,153,839; U.S. application Ser. No. 590,661, filed Sept. 28, 1990, for an "Automated Termination Station and Method of Using the Same", now U.S. Pat. No. 5,125,154; U.S. application Ser. No. 07/892,153, filed Jun. 2, 1992, for a "Wire Reel for Handling Coils of Wire"; U.S. Pat. No. 4,803,778, issued on Feb. 14, 1989, for a "Method for Making a Wire Harness"; and U.S. Pat. No. 4,520,966, issued on Jun. 4, 1985, for a "Wire Canister for a Robotic Wire Harness Assembly System".

BACKGROUND ART

The wire reeler or pin hub disclosed here is designed to be used in conjunction with interchangeable wire reels or reel cartridges. In use, an empty reel is mounted via a robotic arm to a pin hub constructed in accordance with the present invention. Thereafter, the leading end of a continuous wire is fed from a feed station and is clamped directly to the reel. This is followed by driving the pin hub in rotation, which correspondingly drives the reel in rotation, and draws the wire from the feed station and winds it into a coil about the reel. The pin hub rotates until a selected length or segment of the wire is wound onto the reel. Then, the wire is clamped and cut, thereby severing it from the feed station and defining the aft end of the coiled segment.

The reel carries the clamps required for holding the leading and aft ends of the wire segment described above. Further details of the clamping and winding operation will be described in later portions of this document as they are germane to the invention.

After winding, cutting and clamping the segment as just described, the robotic arm removes the reel from the pin hub, and transports it for storage or use elsewhere. Another empty reel is then placed by the arm on the pin hub, and the winding process is repeated, but for a new segment.

The pin hub disclosed here is a further development made in conjunction with an automated wire harness assembly system that is presently under development by The Boeing Company. As is well known, Boeing is a manufacturer of passenger jets, and other, related aerospace products.

Large numbers of wire harnesses are used in the manufacture of commercial jets. These harnesses are typically made up of bundles of individual wire segments having varying lengths. Traditionally, they are assembled or bound together by hand. Such assembly is, of course, extremely labor intensive, and significant cost savings could be achieved if such process were automated.

For this reason, Boeing has long been involved in the in-house development of an automated system for producing wire harnesses. A portion of the system presently under development by Boeing is disclosed in U.S. Pat. No. 4,803,778, which was identified above. The present invention is related to the subject matter of the '778 patent, but more particularly, it is meant to replace the wire reeler disclosed in U.S. Pat. No. 4,520,966 (the '966 reeler), which was also identified above.

During the course of further research and development, it became apparent that the '966 reeler had certain drawbacks, or that other improvements or changes to the automated system as a whole required a new reeler design. As was discussed in the specification of the '966 patent, it was a design goal to produce transportable wire canisters having the capability of accepting, storing and later dispensing individual wire segments during the automated assembly of a wire harness. It is now estimated that an automated system may require a separate reel or wire cartridge for each wire segment, and that literally thousands of individual segments will be processed should an automated harness manufacturing system eventually be implemented. Given the apparently large numbers involved, the '966 canister is too large and cumbersome to be of practical use. In comparison, the hub design disclosed here, which is to be used in combination with an improved reel design (the latter being the subject of my co-pending application Ser. No. 07/892,153) eliminates some, if not all, of the '966 canister's drawbacks.

An important goal of the Boeing system is to use robotic handling devices as much as possible. It is relatively easy to use a robotic arm for the purpose of placing and/or removing a wire reel to and from a pin hub. In contrast, it is difficult to design an automated way to guide the leading end of the wire from a feed station into a clamp on the reel, although it is believed that the reel design which is the subject of my co-pending application makes that particular problem solvable. Nevertheless, further technical problems are presented at the end of the operation, i.e. clamping and severing the aft end of the segment, because the other clamp on the reel most likely will not be in the correct clamping position or location at the time winding stops.

Since the length of each wire segment will typically vary from one reel to the next, the number of rotations of the pin hub required for each winding operation will also vary. The end result is that the particular reel clamp whose function is to capture the wire, prior to severing it from the feed station, will not be in the appropriate angular position when winding stops. Therefore, it is likely that further rotation of both the pin hub and reel will be required in order to properly position the clamp, but at the same time, such rotation must occur without taking up more wire from the feed station, or otherwise subjecting the wire to an unacceptable amount of tension.

Furthermore, in an automated system, when a wire segment is wound onto a reel, and there is to be subsequent automated processing of one or both ends of the segment (e.g., gripping a segment end for removing insulation, or for attaching an end connector), it is necessary that both segment ends be in a known geometric position. Otherwise, other automated equipment would not be able to access the ends for subsequent processing. Therefore, when winding stops, and the aft-end clamp is not in the appropriate "home" position, the pin hub and reel must permit further rotation to "home" without affecting what will ultimately be the segment end geometry.

Different approaches have been used by others in an attempt to solve the above-described problems. For example, the Vectronics Corp. of San Diego, Calif., has used a wire reel or handler that has opposing flexible sides with lips that close over the segment as it enters into an enclosed space. After winding, the coiled segment, if allowed to slacken, cannot escape the enclosure defined by the reel. When the aft end of the segment is reached during the winding process, the Vectronics reel is rotated to an angular "home" position by rotating the reel backwards the necessary angular amount. Such rotation is made possible because the internally-coiled wire goes slack due to the backward rotation, and the closed lips just described above prevent the slack wire from escaping from the reel. The known drawbacks to this design are that it does not adequately contain the wire as it slackens, and further, it does not provide the capability of rotating in both directions.

Another known approach to the "home" position problem is to use only one, forward direction of rotation at all times, with a special hub known in the field as a "magic hub". This type of wire handler has a small, fixed inner hub (approximately 1 inch in diameter) and a larger outer hub (approximately 2.5 inches in diameter) that is formed by flexing one hub sidewall in closing contact against another, opposite sidewall. During the winding process, the wire segment is initially reeled onto the outer hub while it is in a closed position. In other words, the wire is wound while the hub sidewalls are closed. When the second or aft end position of the wire arrives, the hub is then relaxed, which opens a gap between the sidewalls down to the fixed, inner hub. This enables the hub to be rotated further in the same direction until the home position is reached, and the slack required for such further rotation is provided by pulling some of the coils of the already wound segment into the gap region between the two hubs.

The "magic hub" method has its own, unique drawbacks. First, it is highly complex, and thus creates higher costs in view of the very large number of wire handlers or reels that will be needed for an automated handling system. Second, when the leading end and initial portion of small gauge wire types are reeled under tension onto such hub, they tend to be pulled between the contacting sidewalls of the outer hub and down onto the inner hub. This can make it difficult to later attain the "home" position. Lastly, there is no positive way to assure that the initial turns of the wire segment around the outer hub will be sufficiently aligned over the gap, when it is subsequently created, in order to assure that at least some coils will move down onto the inner hub when the gap is opened.

As will become apparent, the present invention enables further rotation of a reel into the "home" position without pulling more wire from the feed station, or otherwise placing the wire under an undue amount of tension. The invention also enables rotation in either direction, in order to efficiently clamp the aft end of each segment prior to severing it from the feed station. Lastly, the invention enables predetermined lengths of wire segments to be reeled onto a maneuverable reel device where both ends of the wire are maintained in known geometric positions for subsequent processing in an automated harness assembly system.

In addition to the above, a pin hub in accordance with the invention provides a reel-drive mechanism that is under the control of the mechanism which drives the wire-reeling process. Only a single pin hub is required for winding various individual segments onto any number of different reels. This makes wire handling much more cost effective as a whole, because the cost of the hub is but for a single unit, and is independent of the cost of producing the numerous reels that would be required in order to process the large number of wire segments that are presently anticipated. In conjunction with cost, inspection and maintenance is made much easier with the present pin hub, because only a single reeler device must be inspected, as opposed to many.

How the invention functions to solve the above-described problems and to provide the above-described advantages will become apparent to the skilled person upon consideration of the disclosure which follows.

SUMMARY OF THE INVENTION

In summary, the invention is a device for driving interchangeable wire reels in rotation, for the purpose of winding individual wire segments of predetermined length onto each reel. A device in accordance with the invention includes a hub member having a forward portion or mounting area to which individual reels are mountable, one at a time. The pin hub also has a plurality of pin members with end portions that are extendible and retractable relative to the hub forward portion. The pin members are fixedly connected to a rearward or pinplate portion of the hub member, and both the forward and rearward portions simultaneously rotate about an axis during winding. However, the rearward portion is reciprocatably movable relative to the forward portion, generally along or parallel to the axis of rotation, for extending and retracting the pin members.

The pin members are retracted at the time a reel is mounted to the hub member. Each reel has a plurality of side openings. After it is mounted to the hub, the pin members are thereafter extended, and project or extend through the side openings in the reel. In doing so, a portion of the pins are received within the winding space of the reel itself, and thereby define a winding path about which the wire is pulled and wound onto the reel as the hub and reel rotate together.

After the wire is fully wound, or in other words, the selected length or segment has been wound onto the reel, the pins are then retracted. This accomplishes two functions. First, the pins must be retracted at some point in order to demount the reel from the pin hub. Before that is done, however, it is necessary that the reel be rotated to a certain known "home" position, so that the aft end of the segment may be clamped, and so that the reel may later be gripped by a robotic arm, at least if the reel and pin hub are to be used in an automated process.

Since the various wire segments that are to be wound onto different reels will have varying lengths, the number of rotations required to wind any given segment will vary from one reel to the next. The end result is that the pin hub may very well stop rotating and winding when the reel is at some angular position that is different from its initial position, or otherwise different from its "home" position. Retracting the pins enables the cartridge to complete a full rotation so that it may return to its initial or "home" position.

The pin members are arranged in a circular pattern so as to define a circular winding path inside the reel. The end portion or region of each pin member is not circular in crosssection. That is to say, each pin member has an outer radial surface portion that is shaped in a manner so as to be congruent with a circular arc that is concentric with the center point of all the pin members. This provides a greater area of surface contact for the wire as it is wound about the pin members, and thereby reduces the stress placed on the wire, or at least on certain points of the wire, and also prevents kinks from being induced into the wire. Further, the end portion of each pin member has a tapered region for making it easier to withdraw all of the pin members from inside a coiled segment during retraction of the pin members. It is probably important that the tapered region pass through the reel all the way to the outer extremity of each pin member.

In an alternative embodiment of the invention, instead of retracting the pin members in order to rotationally maneuver the reel into the "home" position, or for otherwise clamping the aft end of a wire segment, it is possible to allow the pin members to first move radially inwardly toward the center of the hub. This would provide slack in the coil in order to further wind the reel as needed without pulling additional wire from the feed station.

It is a primary object of the invention to provide a pin hub and reel design that will solve the problems associated with automatically winding segments of wire onto individual reels from a continuous wire that is fed from a feed station. In conjunction with this, it is a further object of the invention to provide a pin hub and reel combination that is conducive to the use of robotic arms or maneuvering devices for mounting and demounting individual reels to and from the pin hub. As will become apparent, it is believed the pin hub disclosed here meets these objects.

The invention as briefly described above will be further described in greater detail below. Attention is now directed to the following description, and to the appended drawings.

BRIEF DESCRIPTION OF THE DRAWINGS

In the drawings, like reference numerals and letters refer to like parts throughout the various views, unless specifically indicated otherwise, and wherein.

BEST MODE FOR CARRYING OUT THE INVENTION

Figures 1, 2:
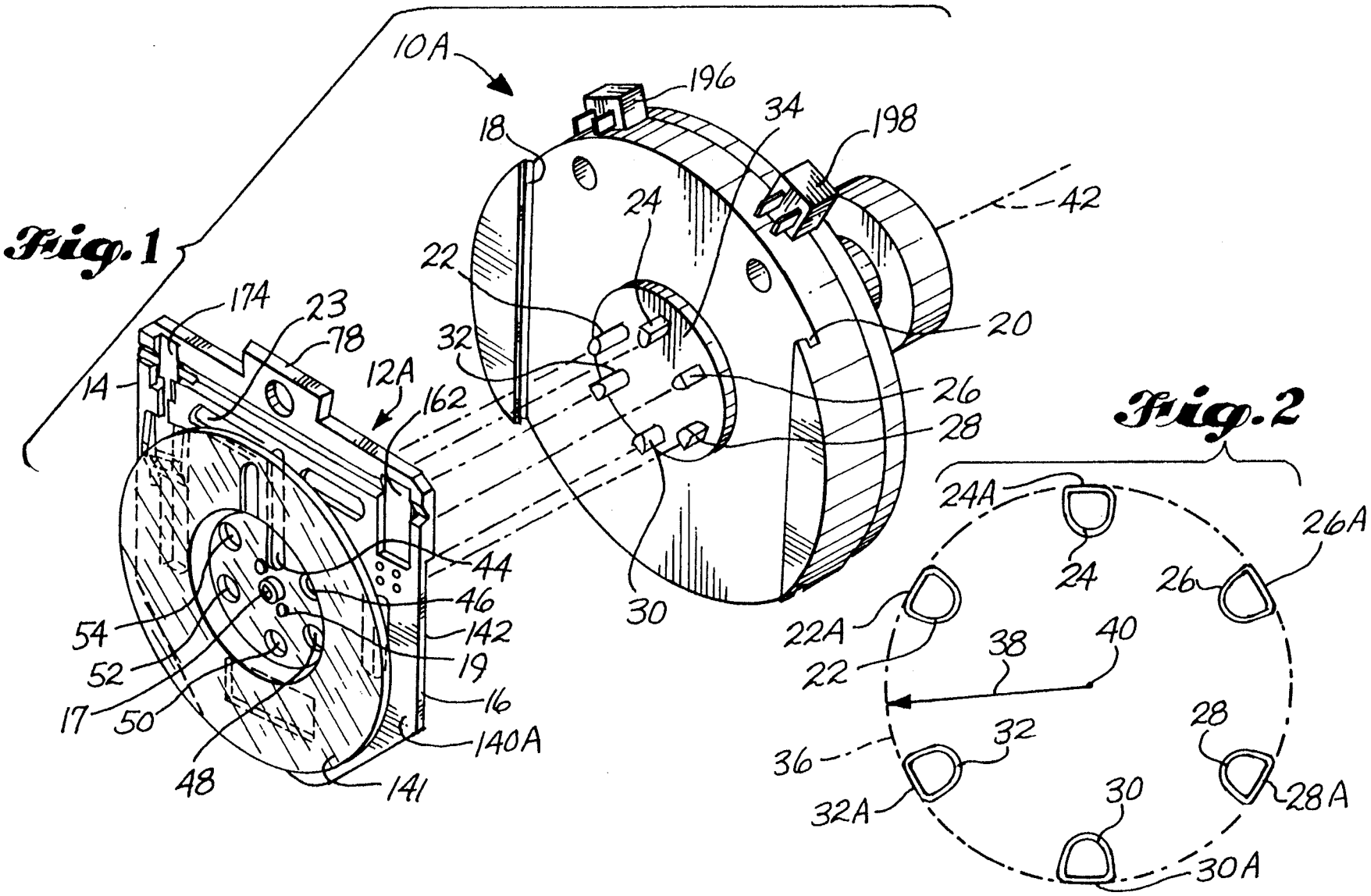
FIG. 1 is a pictorial view of a pin hub or wire reeler in accordance with a preferred embodiment of the invention, and illustrates how an interchangeable wire reel is mounted to the pin hub.
FIG. 2 is a schematic view of a plurality of pin members or pins which extend or project forwardly of the pin hub shown in FIG. 1, and illustrates how certain radial surface portions of each pin are curved so as to be congruent with the curvature of a winding circle.

Referring now to the drawings, and first to FIG. 1, therein is shown generally at 10A, a wire-reeling pin hub in accordance with the invention. The pin hub 10A is mounted onto and controlled by a drive mechanism which will be described later in greater detail. The drive mechanism drives the pin hub 10A in rotation during a wire-reeling process. During such process, an interchangeable wire reel 12A is mounted to the pin hub 10A. With respect to the embodiment shown in FIG. 1, the reel 12A is connected to the pin hub 10A by sliding it downwardly so that the reel's outer edges 14, 16 are respectively engaged in slots 18, 20 on opposite lateral sides of the pin hub 10A.

The pin hub 10A has six pins 22, 24, 26, 28, 30, 32 which project forwardly of a forward portion or front mounting surface area 34 of the pin hub. Such pins 22, 24, 26, 28, 30, 32 are extendible and retractable relative to surface area 34 in a manner which will be described later. Naturally, they would be in a retracted position at the time the reel 12A is mounted to the pin hub 10A.

Referring now to FIG. 2, the pins 22, 24, 26, 28, 30, 32 all have outer radial surface portions 22A, 24A, 26A, 28A, 30A, 32A which are congruent with a circle 36. The circle 36 has a radius 38 that originates at a point 40 which is centrally located and defines the axis 42 (see FIG. 1) about which the pin hub 10A rotates. This presents a larger area of surface contact for individual wire segments as they are reeled onto the reel 12A, in a manner which is further described later. By way of further explanation, if the various pins 22, 24, 26, 28, 30, 32 were circular in cross-section, then the wire would more or less be in contact with a point on each pin and extend tangentially relative to most of the pin's circular cross-section. This would cause a higher amount of stress to be placed on the point of contact than is placed by having a portion of each pin radiused as shown in FIG. 2, and thus kink the wire at these points of contact. The outer radial surface portions 22A, 24A, 26A, 28A, 30A, 32A provide a much greater contact area, and thereby reduce stress on the wire.

After the reel 12A is mounted to the pin hub 10A, the pins 22, 24, 26, 28, 30, 32 are extended through corresponding side openings 44, 46, 48, 50, 52, 54 in the reel 12A. The end portions of the pins 22, 24, 26, 28, 30, 32 thereby define a winding surface or circle about which the wire segment is wound onto the reel 12A as the pin hub drives it in rotation.

Figure 19:
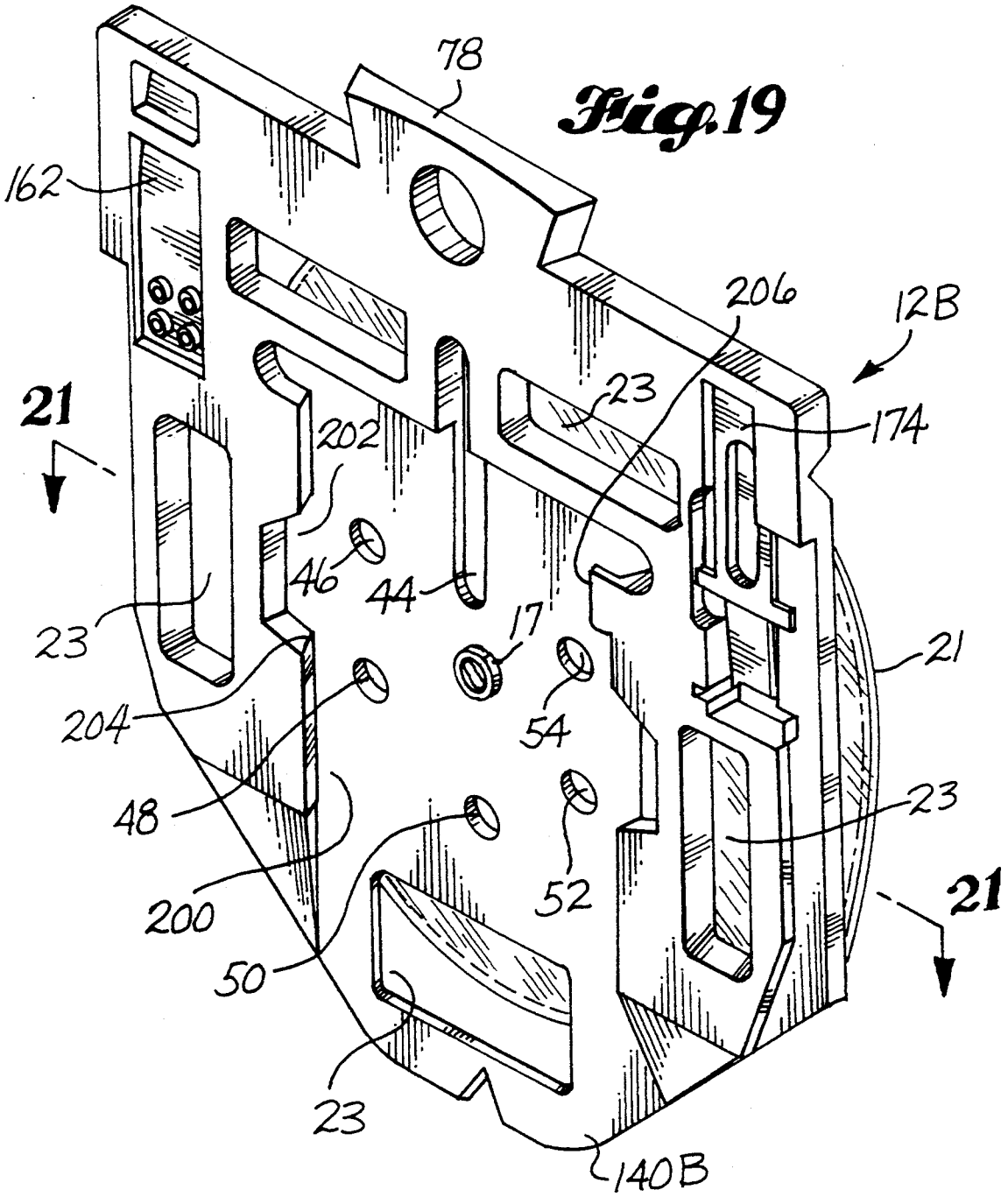
FIG. 19 is a pictorial view looking at the rear face of the currently preferred embodiment of the reel.
Figure 20:
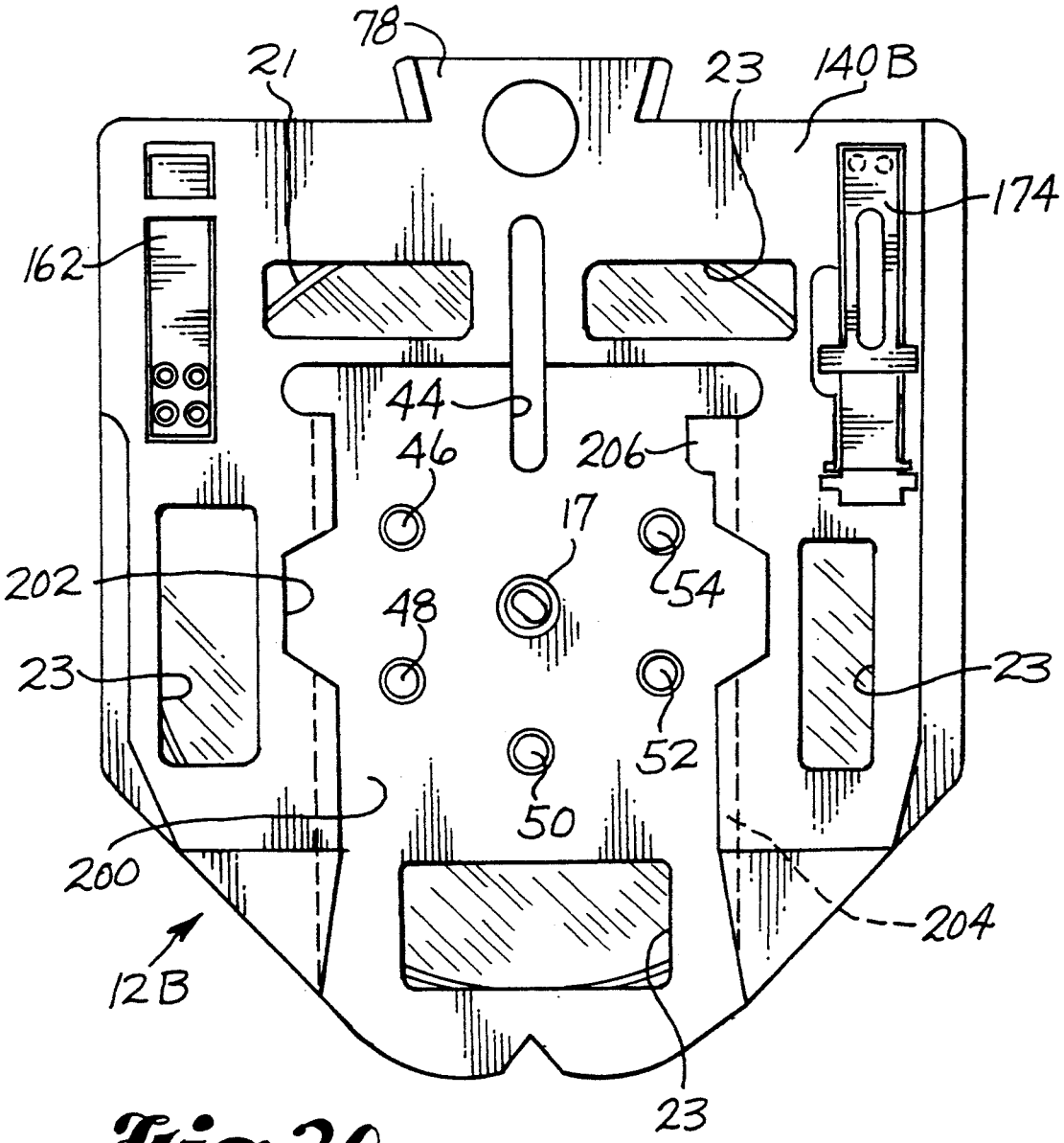
FIG. 20 is a rear elevational view of the reel shown in FIG. 19.
Figure 21:
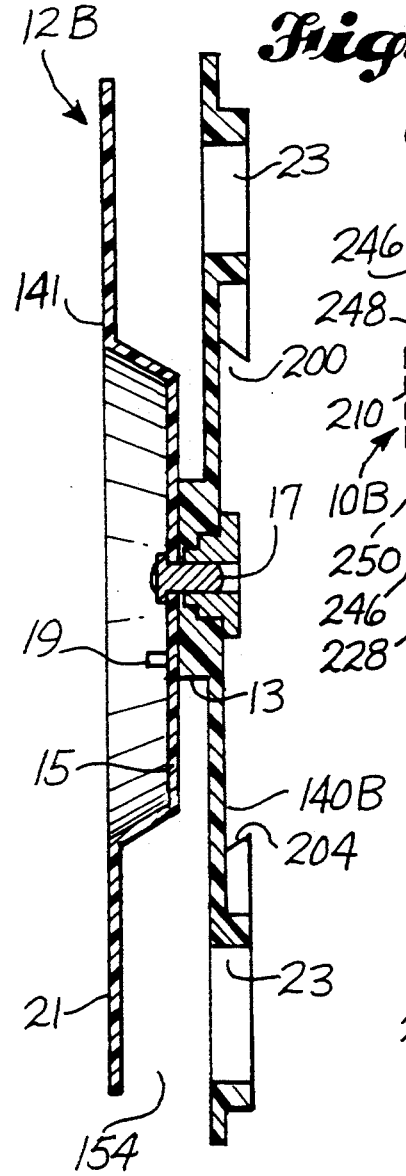
FIG. 21 is a sectional view taken along the line 21—21 in FIG. 19.

The manner in which the pin hub of the invention engages a reel may be varied. Another embodiment of the pin hub 10B which engages a reel 12B by means of spring biased gripping members 210, 212 is illustrated in FIGS. 4, 7–10, and 22–24. The corresponding reel 12B is shown in FIGS. 7, 19–21, and 24, and is best seen in FIGS. 19–21. The reel 12B includes a stiff-back member 140B and a circular flange member 141. The stiff-back member 140B has an axially projecting center hub 13 that is secured to a center portion 15 of a flange member 141 by a screw 17. A pair of locator pins 19 ensure proper alignment of the two reel members 140B, 141. The main body of the stiff-back member 140B forms a first flange that is axially spaced apart from the radially outer portions 21 of the flange member 141. A winding space 154 is defined between the two flanges 140B, 21. The stiff-back member 140B is provided with a plurality of lightening holes 23 to help minimize its weight. Referring to FIGS. 19–21, a recess 200 is formed on the rear face of the stiff-back member 140B. Each of the opposite lateral edges of the recess 200 has a central enlarged width portion 202 and beveled edges 204 extending outwardly from each end of the central portion 202. Preferably, the beveled edges 204 are provided with lip portions, such as the lip 206 shown in FIGS. 19, 20, 24, for the purpose described below.

The hub 10B includes a pair of gripping members 210, 212 mounted on the forward face of a mounting plate 138. Each gripping member 210, 212 has a lateral projection 214 corresponding to the enlarged width portion 202 of the recess 200 on the reel 12B, and beveled edges 216 extending in opposite directions from the base of the projection 214. Each gripping member 210, 212 also has a pair of openings 218 for receiving two of the retractable pins 22–32 carried by the pin hub 10B. The gripping members 210, 212 are spring biased outwardly and are engaged by elements of the drive mechanism to move them against the force of the spring biasing.

In order to avoid having the biasing and actuating mechanisms interfere with the winding of wire on a reel, these mechanisms are carried at the rear of the mounting plate 138. A pair of engagement lugs 220, 222 corresponding to the gripping members 210, 212 are mounted on the rear face of the mounting plate 138. These engagement lugs 220, 222 are biased away from each other by springs 224. Each lug 220, 222 has a lateral projection 226 and opposite vertical projections 228. Four of the pins 24, 26, 30, 32 carried by the pin hub 10B project through the lugs 220, 222 even when the pins are in their retracted position. Slots 232 provide clearance for the pins to permit the lugs 220, 222 to be moved toward and away from each other. Fasteners 234 extend through the mounting plate 138 and are secured to their respective gripping members 210, 212 and engagement lugs 220, 222 so that movement of the lugs 220, 222 will cause corresponding movement of the gripping members 210, 212. The mounting plate 138 is provided with appropriate slots for the fasteners 234.

Figure 22:
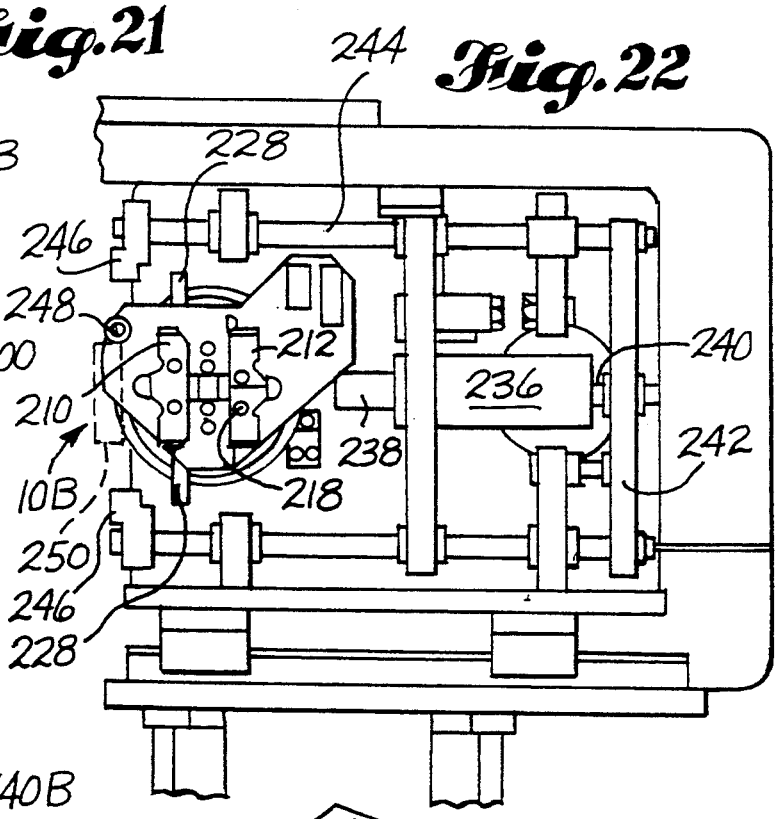
FIG. 22 is a partially schematic elevational view of winding apparatus illustrating means for engaging the reel shown in FIGS. 19–21.
Figure 23:
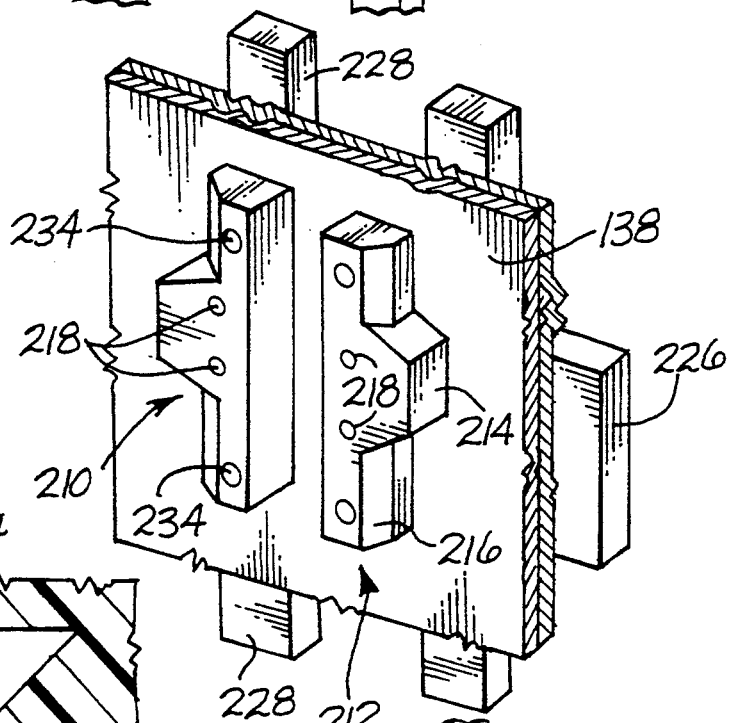
FIG. 23 is an enlarged fragmentary pictorial view of the engagement means shown in FIG. 22.

FIG. 22 illustrates the means by which the gripping members 210, 212 are moved toward each other against the force of the springs 224. The mounting frame for the pin hub 10B and its drive mechanism also mounts a cylinder 236. A first piston 238 extends laterally from the cylinder 236 toward the engagement lugs 220, 222. A second piston 240 extends from the opposite end of the cylinder away from the hub 10B. The first piston 238 engages the lateral projection 226 on the adjacent engagement lug 222 to move one of the gripping members 212 toward the center of the hub 10B. The second piston 240 engages a bar 242 having opposite upper and lower ends each of which engages linkage 244. The upper and lower arms of the linkage 244 extend above and below the pin hub 10B, respectively. A pull member 246 is carried by the end of each arm of the linkage 244 opposite the bar 242. When a reel 12B is to be mounted on the hub 10B or removed therefrom, the cylinder 236 is activated to extend both pistons 238, 240 and thereby move the gripping members 210, 212 toward each other to disengage them from the recess 200 in the reel 12B. When the reel 12B is being mounted, the pistons 238, 240 are retracted when the reel 12B has been positioned to permit the springs 224 to move the gripping members 210, 212 into gripping engagement with the recess 200 on the reel 12B.

Figure 24:
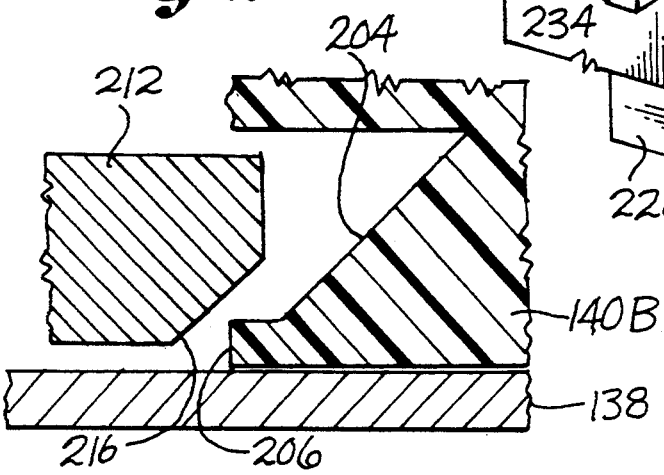
FIG. 24 is a simplified fragmentary sectional view illustrating the engagement of a reel.

FIG. 24 illustrates the function of the lip 206 on the back of the reel 12B. As the gripping member 212 moves into engagement with the reel stiff-back member 140B, the beveled edge 216 of the gripping member 212 engages the lip 206 to push the stiff-back member 140B firmly against the mounting plate 138.

The engagement of the reel 12B by the gripping members 210, 212 may be sufficient to hold the reel 12B firmly in place on the pin hub 10B. However, in some circumstances, it is desirable to have an additional means for engaging an edge of the stiff-back member 140B. FIG. 22 illustrates a projection 250 on the pin hub 10B for this purpose. The projection 250 has a groove formed thereon similar to the grooves 18, 20 shown in FIG. 1. One of the edges of the stiff-back member 140B is engaged in this groove to prevent distortion of the member 140B when a pin 248 carried by the hub 10B is extended to open a clamp 174 carried by the reel 12B.

Figure 3:
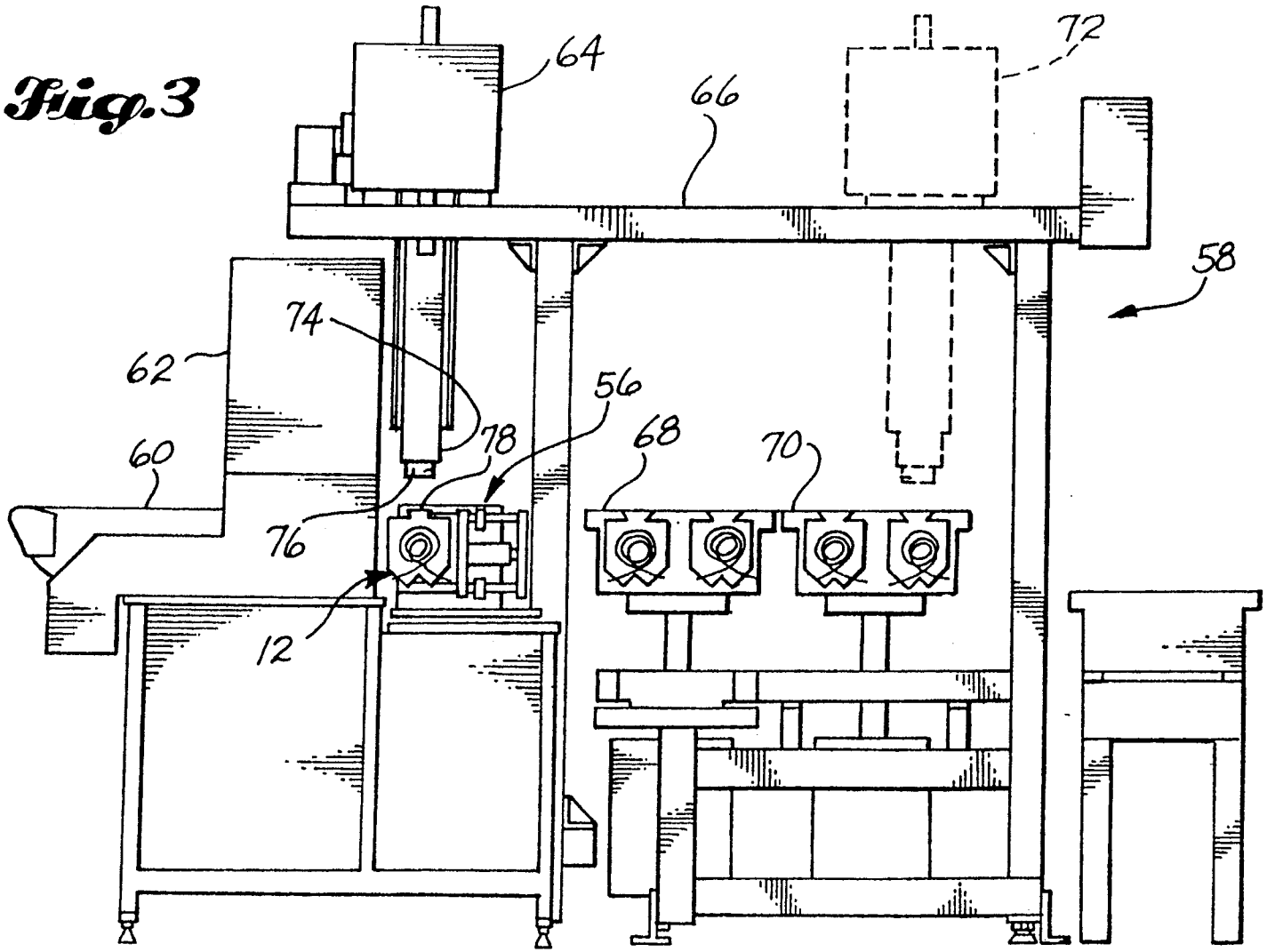
FIG. 3 is a schematic view of a reeling and winding station, and illustrates how reels are robotically moved to and from a wire feeler in accordance with the invention.

The pin hub drive mechanism may take the same form regardless of the particular form of the engagement portions of the pin hub. The drive mechanism is illustrated in FIGS. 3–8. In FIGS. 5 and 6, the pin hub is shown somewhat schematically to represent a generic pin hub 10. Referring now to FIG. 3, the drive mechanism is generally indicated at 56, and its location relative to a portion of an automated wire handling system is indicated generally at 58. Briefly, the wire handling system 58 feeds a portion of a continuous wire 60 from a feed station 62 to the pin hub 10 and its drive mechanism 56, and the leading end 61 (see FIG. 12) of the wire 60 is clamped onto a reel 12 that is mounted to the pin hub 10. Thereafter, the pin hub 10 is driven in rotation until a preselected length, or segment, that is to be cut from the wire is coiled onto the reel 12. At such time, the aft end of the segment is clamped onto the reel 12, and the segment is cut or severed from wire 60 via a suitable cutting tool 63 (FIGS. 15–18) that is an operational part of feed station 62.

Individual reels 12 are conveyed to and removed from the mechanism 56 by an overhead robot 64. The robot 64 moves back and forth along a track 66 from a position over the pin hub drive mechanism 56 to another position over reel bins 68, 70, as shown by the dashed lines 72. The robot has a downwardly-extending robotic arm 74 with a gripping device 76 at its lowermost extremity. Such arm grips an upper flange portion 78 of the reel 12 for placing the reel 12 onto the pin hub 10, or for removing it and placing it in one of the bins 68, 70. The bins 68, 70 are for storage purposes where filled reels may be stored until the individual wire segments held by each one are required elsewhere. They are also used to transport the reels 12.

Figure 4:
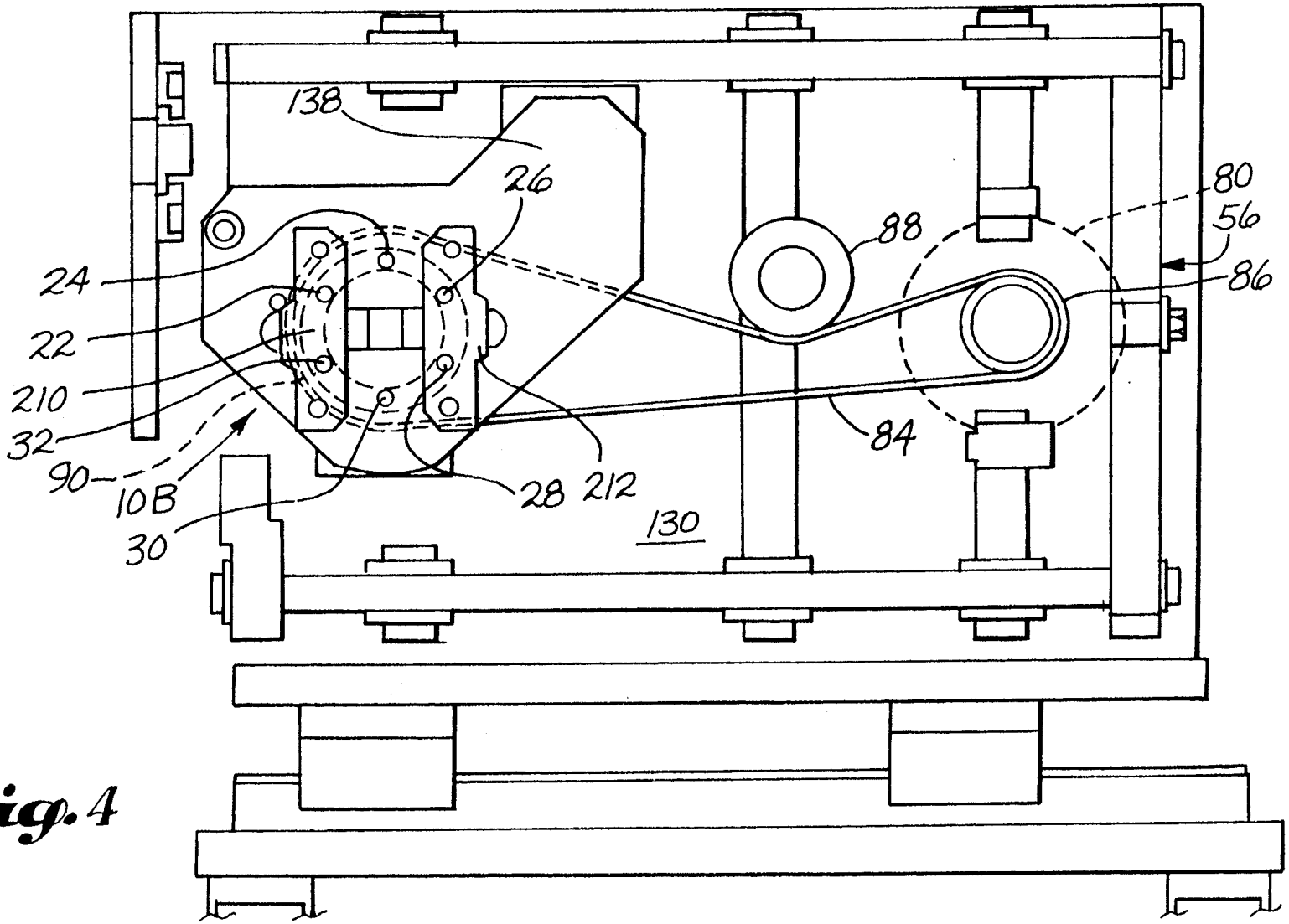
FIG. 4 is a frontal view of a pin hub and reeler drive mechanism in accordance with the invention.
Figure 5:
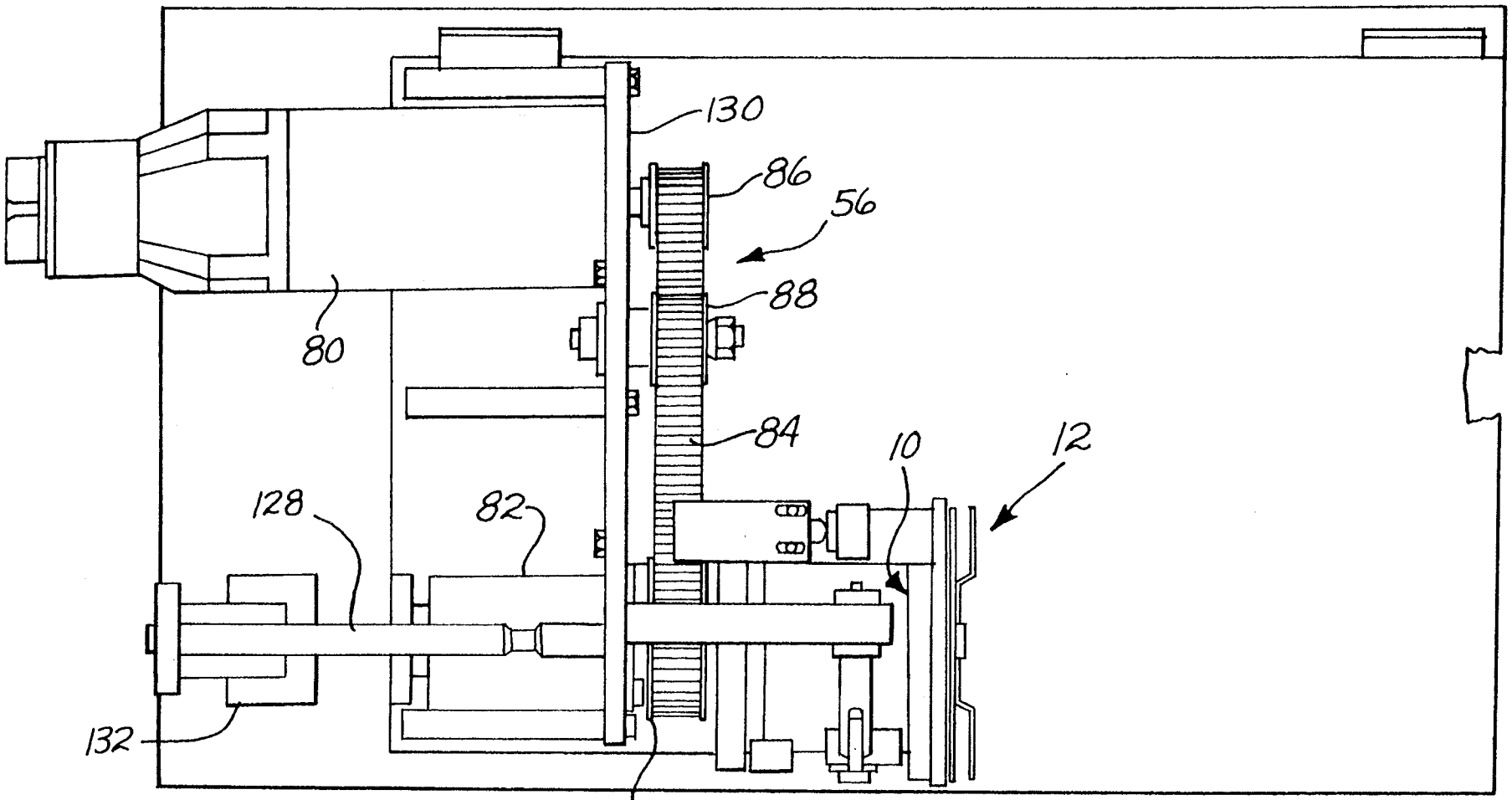
FIG. 5 is a top view of the pin hub and reeler drive mechanism shown in FIG. 4.
Figure 6:
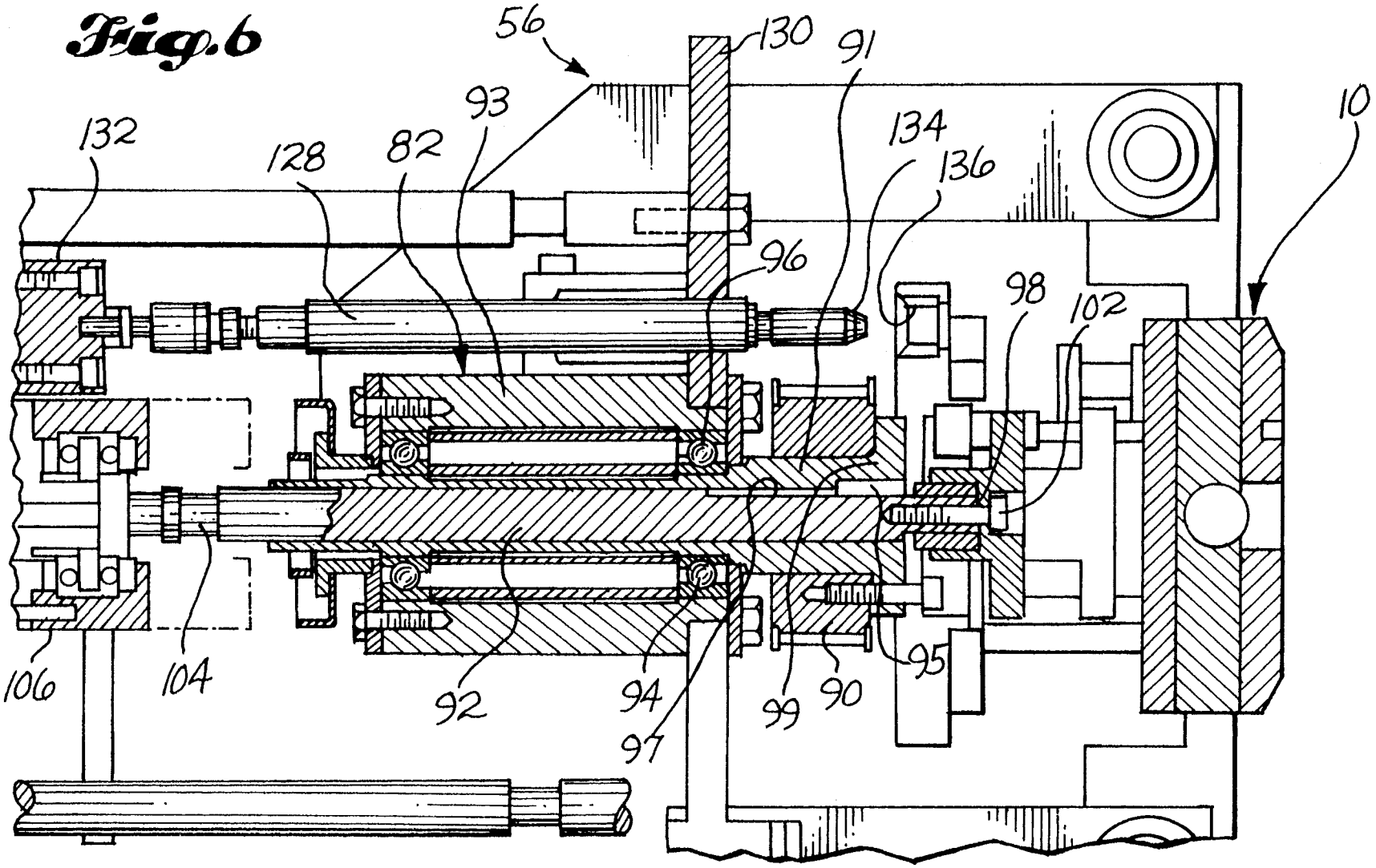
FIG. 6 is a cross-sectional view of the pin hub and reeler drive mechanism shown in FIGS. 4 and 5.

The pin hub drive mechanism 56 is better seen in FIGS. 4–6. Referring first to FIG. 5, therein is shown a top plan view of the drive mechanism 56, with the pin hub 10 being located in the lower, right-hand corner of the drawing, and a reel 12 being shown mounted to the pin hub 10.

Basically, the drive mechanism 56 constitutes a reversible drive motor 80 which is conventional in nature. It is drivingly connected to a shaft mounting assembly 82 via a conventional drive belt 84. The drive belt 84 follows a path around a first pulley 86, at the end of drive motor 80, and then about an idler pulley 88, and further about a shaft drive pulley 90 which is further described below. As is best seen in FIG. 4, the drive belt 84 is more or less conventional in nature, and may be made of any number of suitable belting materials.

Referring to FIG. 6, the shaft-mounting assembly 82 carries a hollow, outer drive shaft 91 whose purpose is to drive the pin hub 10 in rotation. Such shaft is connected by conventional bearings 94, 96 to the housing 93 of the shaft-mounting assembly 82. Rotation of drive motor 80, in turn, causes rotation of drive pulley 90, which further causes outer shaft 91 to rotate.

Slidingly received within the outer shaft 91 is a solid, inner shaft 92. The inner shaft 92 is free to telescopically slide relative to outer shaft 91, along the axis of rotation 42 of the pin hub 10. However, the inner shaft 92 is also driven in rotation correspondingly with rotation of the outer shaft 91. In preferred form, a longitudinally-extending key member 95 is slidingly received in a corresponding longitudinally-extending slot 97 in the inner shaft 92. The key 95 is fixed in position relative to the forward, outer end 99 of the outer shaft 91. Thus, when the outer shaft 91 rotates, the key member drives the inner shaft 92 in rotation as well. At the same time, however, the inner shaft 92 may slide outwardly or inwardly relative to the outer shaft 91 as permitted by groove 97.

One end 98 of the inner shaft 92 is connected to a pin plate 100 via a conventional screw 102 that is threaded into the end 98 of the shaft 92. The other end 104 of the inner shaft 92 is connected to an actuator 106, the latter having the function of driving the shaft 92 back and forth along the axis of rotation 42 of the pin hub 10. The purpose of such movement is, of course, to extend and retract the pins 22, 24, 26, 28, 30, 32 on the pin hub in the manner previously described, and as will now be further described in greater detail below.

Figure 7:
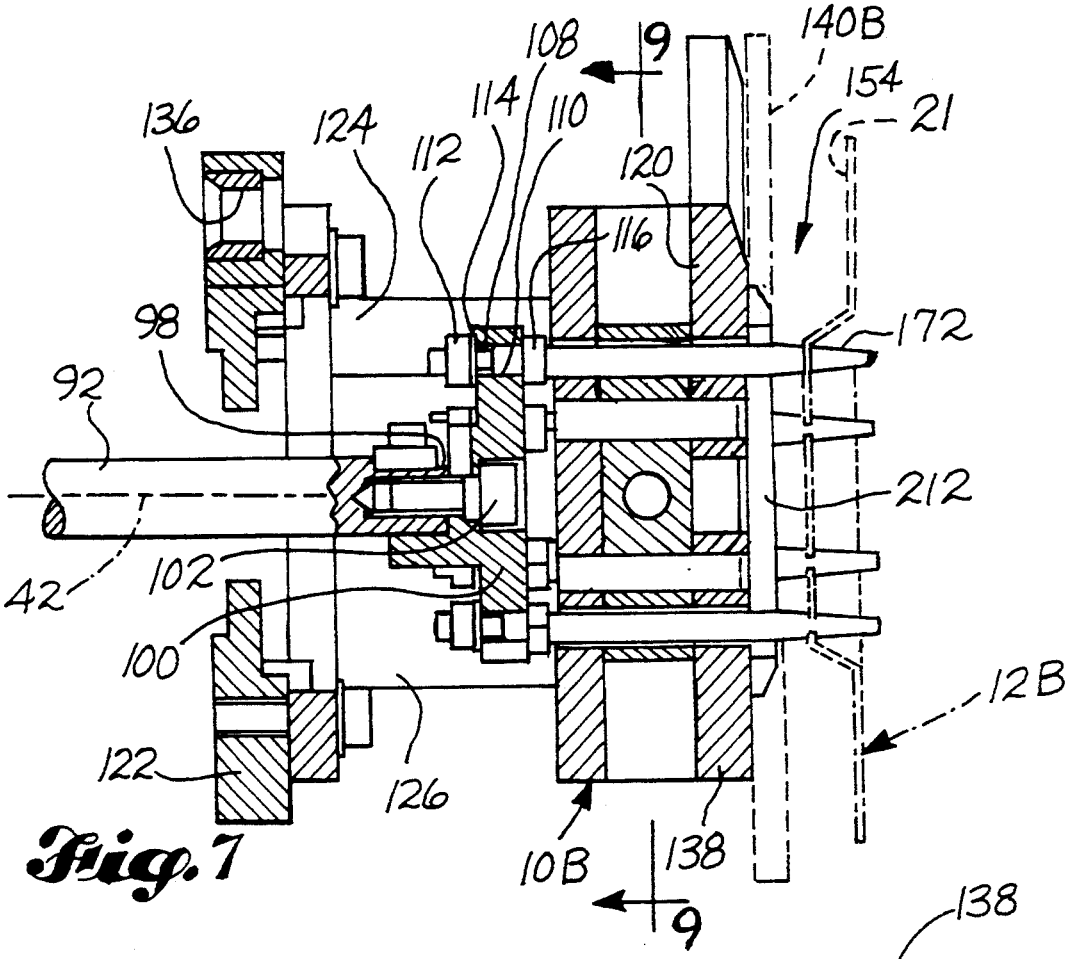
FIG. 7 is an enlarged cross-sectional view of the pin hub portion of the pin hub and reeler drive mechanism shown in FIGS. 4–6.
Figure 8:
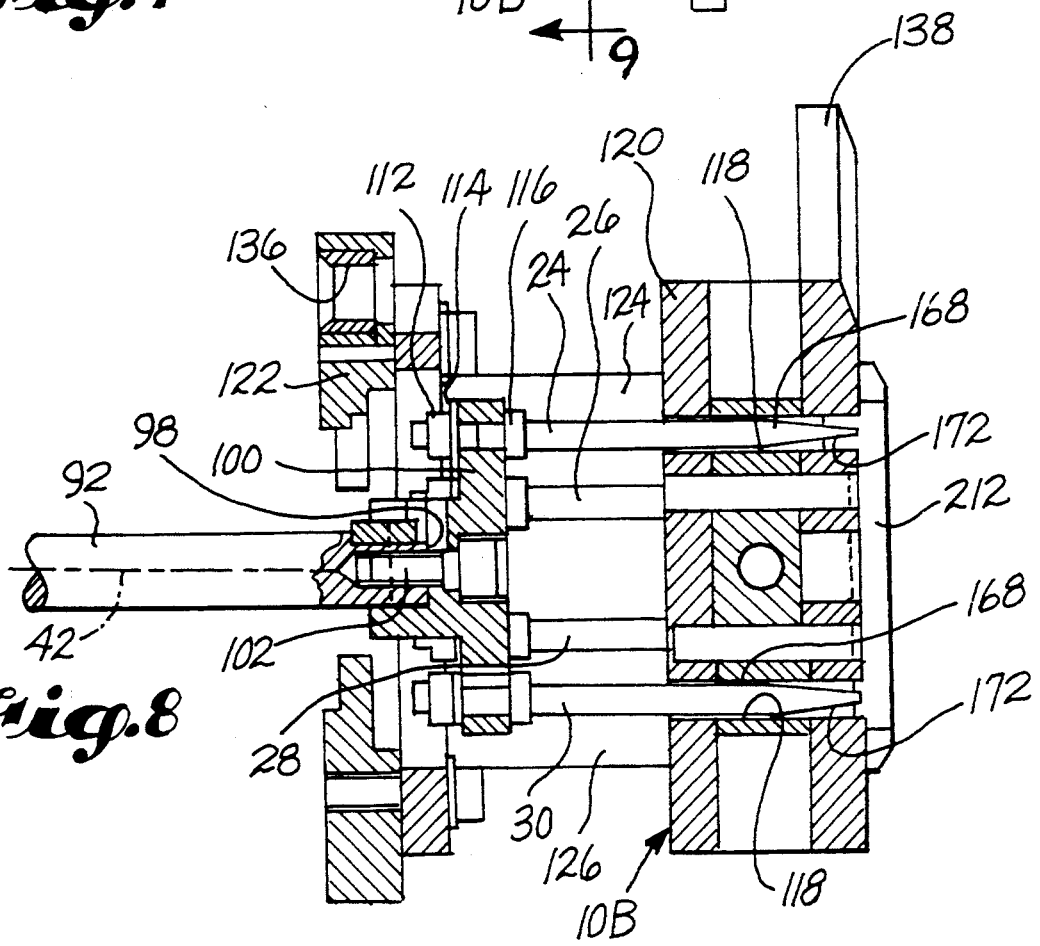
FIG. 8 is a view like FIG. 7, but shows the pins in a retracted position relative to the pin hub.
Figure 9:
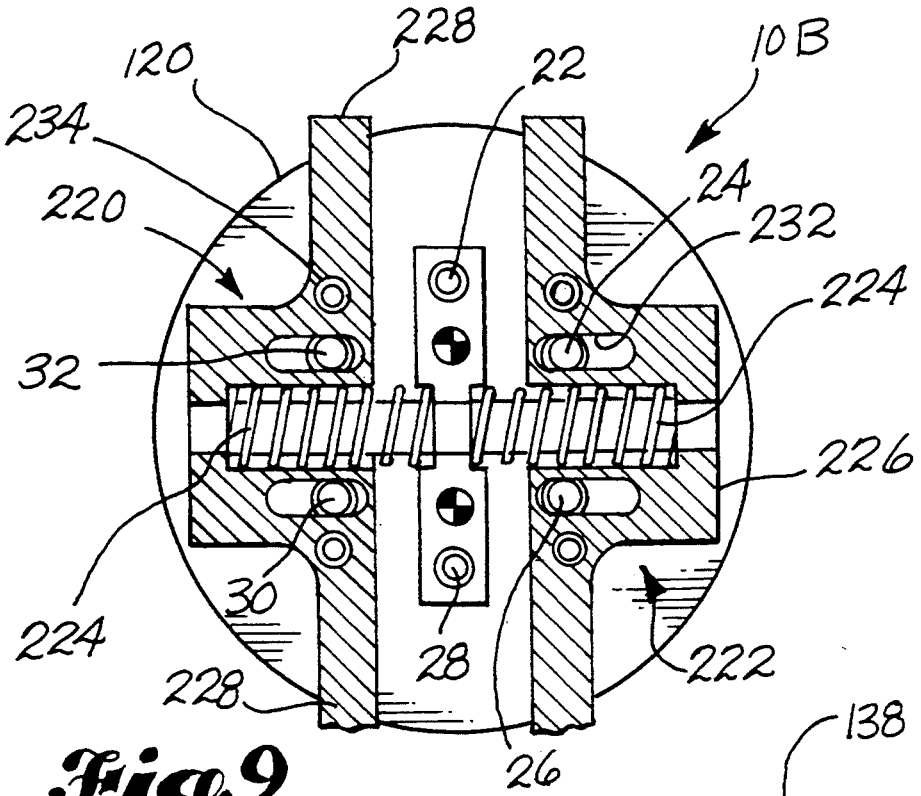
FIG. 9 is a cross-sectional view of the pin hub portion shown in FIGS. 7 and 8, and is taken along line 9—9 in FIG. 7.
Figure 10:
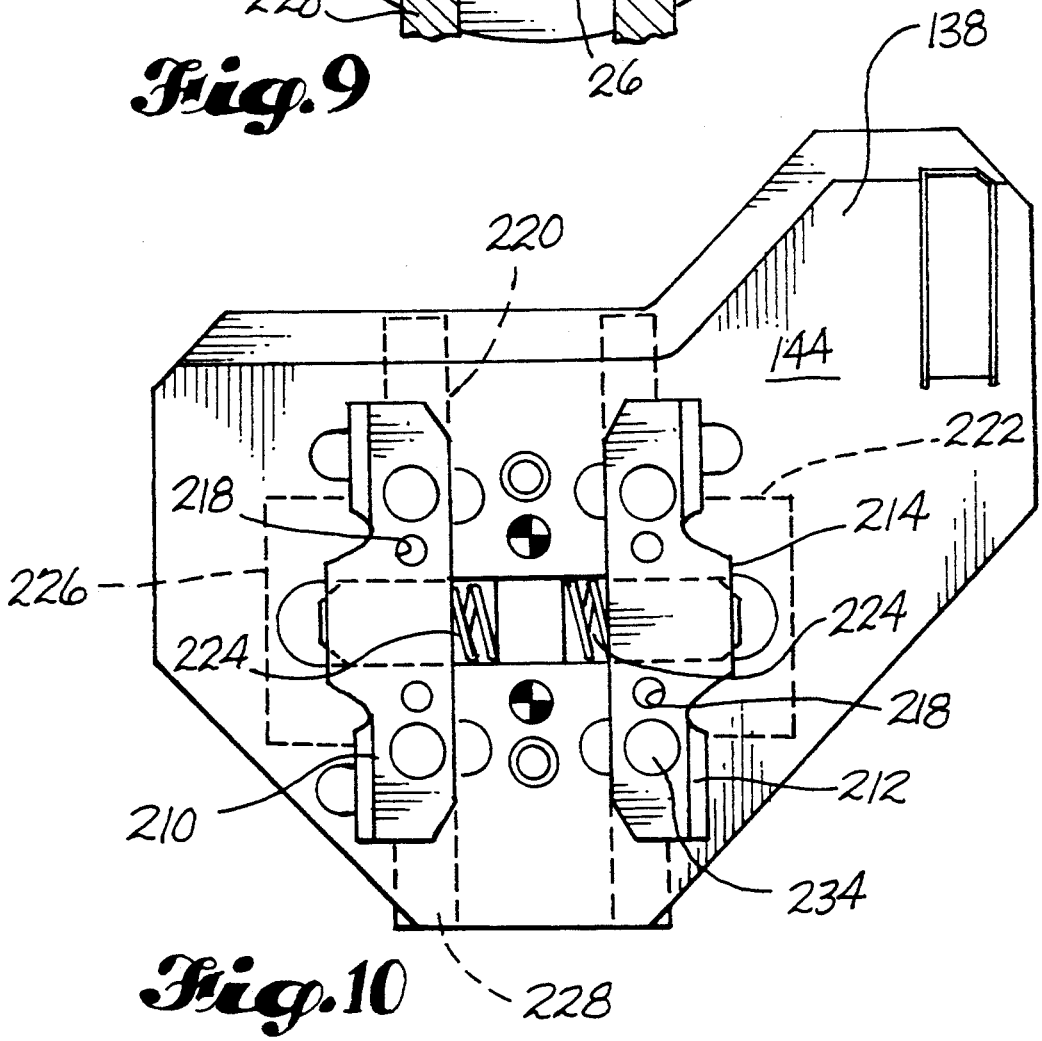
FIG. 10 is a frontal view of a mounting plate or area located on the forward portion of the pin hub shown in FIGS. 7 and 8.

Referring now to FIGS. 7 and 8, each pin 22, 24, 26, 28, 30, 32 is mounted to the pin plate 100. This is accomplished by extending an aft portion 108 of each pin through a bore 110 in the pin plate 100. Such end 108 is threaded, and is fixedly connected to the pin plate 100 by a conventional nut and washer arrangement 112, 114, the latter sandwiching the pin plate 100 between the nut 112 and a radially outwardly-projecting flange portion 116 of the pin. Each pin 22, 24, 26, 28, 30, 32 is mounted to pin plate 100 in such manner.

When the inner shaft 92 is driven forwardly by actuator 106, the pins 22, 24, 26, 28, 30, 32 correspondingly extend or slide through openings 118 in the pin hub 10B. For the sake of better understanding the construction of the pin hub 10B as shown in FIGS. 7 and 8, it is to be understood that such figures are a cross-section of the pin hub, and therefore do not show each one of the six openings in and through the hub which would otherwise be required in order to accommodate all six pins 22, 24, 26, 28, 30, 32. Reference numeral 118 is commonly used to show all of the openings through the pin hub in FIGS. 7 and 8.

When the pins 22, 24, 26, 28, 30, 32 are retracted, they are in the position shown in FIG. 8 with their ends being at least flush with the forward portion of the pin hub 10B. When extended, they are in the position shown in FIG. 7, and extend through the reel 12B which was previously mounted to the forward face 34 of the pin hub 10B.

The pin hub 10 is not primarily driven in rotation by the inner drive shaft 92. Instead, the pin hub 10 is primarily driven by a drive plate 122, which is fixedly connected to the hollow, outer drive shaft 91 (see FIG. 6). As was previously described, outer drive shaft 91 is fixedly connected to drive pulley 90, and is thereby driven in rotation directly by motor 80. Columns 124, 126 fixedly interconnect drive plate 122 with the forward portion 120 of the pin hub, for the purpose of rotationally driving the pin hub 10 and reel 12.

Referring to FIG. 6, it is important that the pin hub 10 be locked or fixed in a predetermined "home" position at the time the robot arm 74 (see FIG. 3) delivers and removes reels 12 to and from the pin hub 10. Therefore, a pin shaft 128 is slidingly mounted to the same frame 130 of drive mechanism 56 to which housing 82 is mounted and serves as a means for locking pin hub rotation. Like the internal, solid drive shaft 92 described above, the pin shaft 128 is also reciprocatingly movable back and forth by an actuator 132.

To ensure that no pin hub rotation will occur during reel mounting or demounting, the motor 80 rotates the tin hub 10 to the desired "home" position, and pin shaft 128 is extended until its forward end 134 engages with a socket 136 in drive plate 122 (see FIG. 6).

Referring now to FIGS. 4, 7–10, and 22–24, in the embodiment of the pin hub shown therein, a mounting plate 138 is mounted to the forward portion 120 of the pin hub 10B. Such plate 138 carries and is connected to the stiff-back portion or back of the reel 140B, as described above.

As was described previously, when the reel 12B is mounted to the pin hub, the pins 22, 24, 26, 28, 30, 32 are in a retracted position as shown in FIG. 8. After the reel is mounted, the pins 22, 24, 26, 28, 30, 32 are extended through the openings 44, 46, 48, 50, 52, 54 in the reel 12B. As shown in FIG. 7, the pins extend through the winding space or coiling area 154 that is defined by the axially spaced-apart flanges of the reel. Referring again to FIG. 3, the wire 60 is wound around the circle 36 (see FIG. 2) that is defined by the pins and, as mentioned previously, the outer radial surface portions 22A, 24A, 26A, 28A, 30A, 32A of the pins provide a larger area of contact than would otherwise be provided if the cross-section of the pins happened to be perfectly circular.

Figure 12:
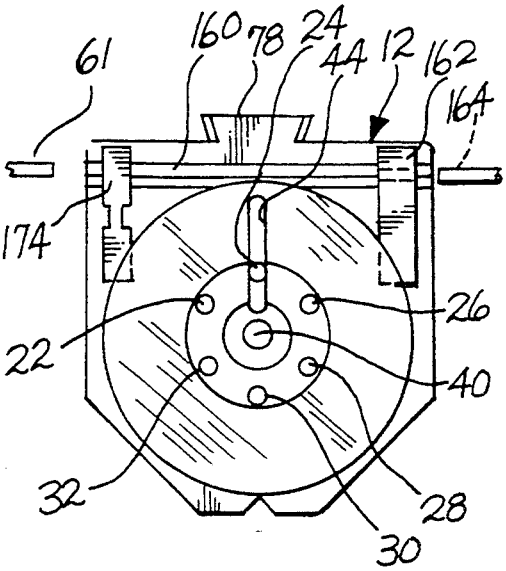
FIG. 12 is the first of a series of three views showing how a wire segment is wound onto the reel shown in FIG. 1, and presents a frontal view of the reel.
Figure 13:
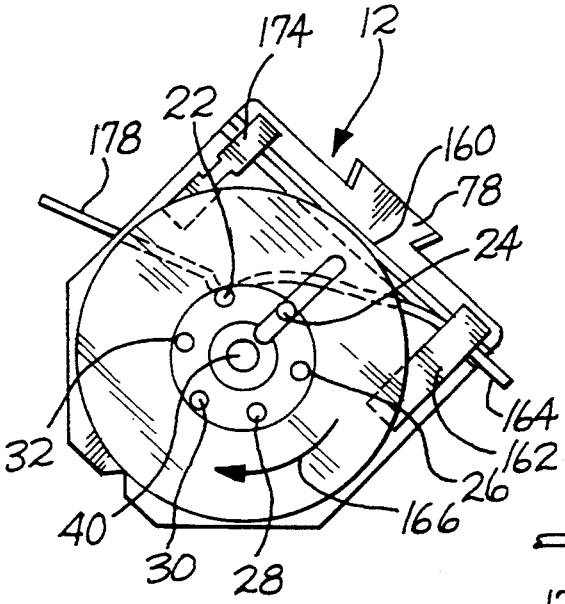
FIG. 13 is a view like FIG. 12, but shows the reel in a different rotational position.
Figure 14:
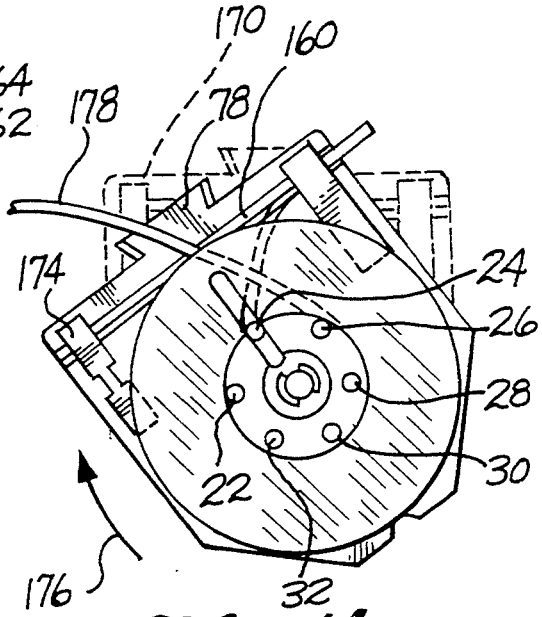
FIG. 14 is a view like FIGS. 12 and 13, but shows the reel in still another rotational position.

Referring now to FIGS. 12–14, the way the pin hub 10 functions during a winding process will now be described. FIG. 12 is a frontal view of the reel 12 mounted to the forward face of the pin hub. In such position, the leading end of a continuous wire 61 is passed from the wire feed station 62 of FIG. 3 across a groove 160 in the top of the reel 12. The leading or first end of the wire is clamped by a first clamp 162 in the upper right-hand corner of the reel 12, in a manner so that a certain length of the wire extends beyond the reel as indicated by reference numeral 164. For a better explanation as to how the first clamp 162 works, reference should be drawn to my co-pending application Ser. No. 07/892,153, although, once again, the way such clamp works is not considered to be important or germane to what is disclosed and claimed as being the invention here.

After the leading end 61 of the wire is clamped, the pin hub 10 is driven in rotation by the drive motor 80 (see FIG. 5) in the clockwise direction indicated by arrow 166 in FIG. 13. This winding process continues until it is determined that the desired segment length has been wound onto the reel 12, and that the position of the aft end of the segment is properly located for being severed from the feed station by a cutting tool 63.

As was mentioned above, the winding action could stop at any one of a number of positions. FIG. 12 essentially illustrates the "home" position where winding would commence. It is also the position the pin hub 10 would assume at the time the reel 12 is both mounted and demounted to and from the pin hub.

FIG. 13 is illustrative of one possible position where rotation could stop, which is approximately 45° beyond the "home" position. At such point, it would have been determined that no more wire should be coiled or wound onto the reel. Therefore, it is necessary to bring the reel 12 and pin hub 10 back to the "home" position shown in FIG. 12, without drawing further wire from feed station 62, or otherwise placing the wire under undue stress.

This is accomplished by retracting the pin hub's pins 22, 24, 26, 28, 30, 32 so that they are in the position shown in FIG. 8. This causes the pin end portions 168 to be withdrawn from within the coil that is created in winding space 154, and creates a certain amount of slack that enables the pin hub and reel to be further rotated, as shown in FIG. 14, until it eventually returns to the "home" position, as indicated by dashed lines 170 in FIG. 14. In order to facilitate retraction of the pins 22, 24, 26, 28, 30, 32 from within the coil, the end portions 168 of all of the pins have tapered regions 172 (see FIGS. 7 and 8).

As was discussed above, the aft end of the segment must be clamped before it is severed. This is accomplished by another clamp 174 that is located in the upper left-hand corner of the reel 12. In the embodiment shown in FIGS. 12–14, it is presently anticipated that the clamp 174 would be open as the reel rotates in the direction shown by arrow 176. This would permit the second clamp 174 to capture the aft end 178 of the segment as the reel returns to the "home" position 170. Then, the aft end 178 is cut, and the winding process is fully completed. Thereafter, and referring once again to FIG. 3, the robotic arm 74 removes the reel 12 from the pin hub 10 and stores the reel along with many others in bins 68, 70. Naturally, an empty reel would be remounted by the robotic arm 74 to the pin hub, and the process just described would be repeated.

Figure 11:
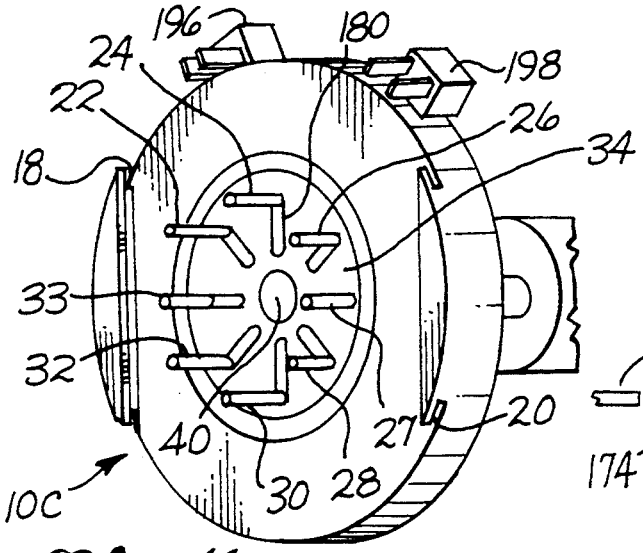
FIG. 11 is a pictorial view of an alternative pin hub embodiment in accordance with the invention.

FIG. 11 shows an alternative embodiment of the pin hub 10C. There, the various pins 22, 24, 26, 27, 28, 30, 32, 33 are not only extendible and retractable relative to forward pin hub surface 34, but they are also movable radially inwardly along slots 180, toward the center point 40 of the hub. This type of hub also addresses, albeit in a slightly different way, the problem of returning both the pin hub and reel to the "home" position after a predetermined length of wire has been wound onto a reel 12C held thereby. The reel 12C is modified to adapt it to the hub 10C.

Figure 15:
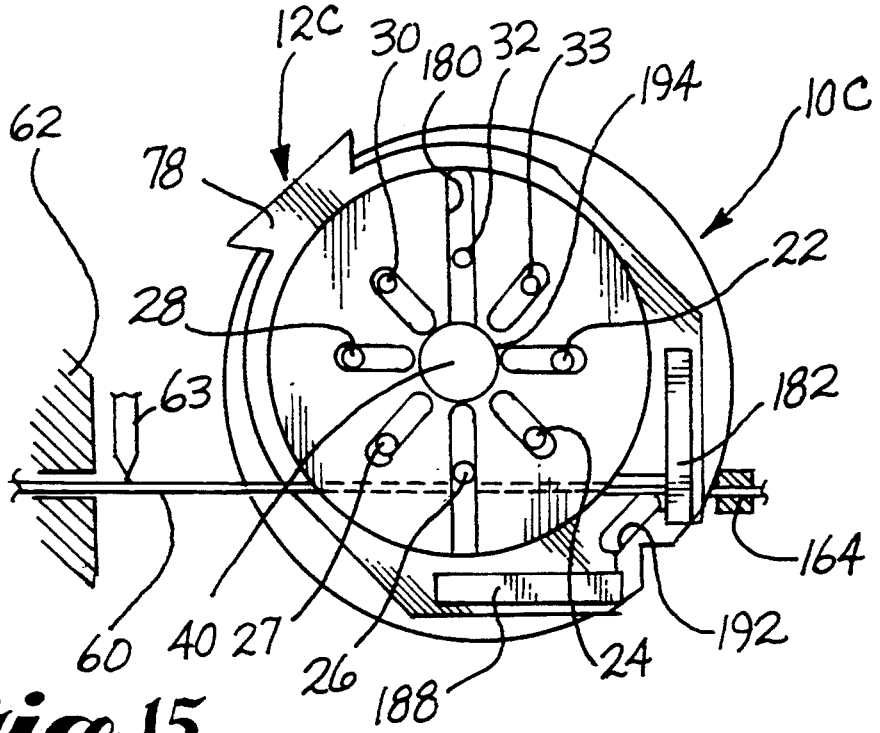
FIG. 15 is the first view in a series of four consecutive views and, similar to FIGS. 12–14, shows a frontal view of an alternative embodiment of a reel on the alternative pin hub embodiment shown in FIG. 11, and illustrates how a wire segment is wound by such pin hub and reel combination.
Figure 16:
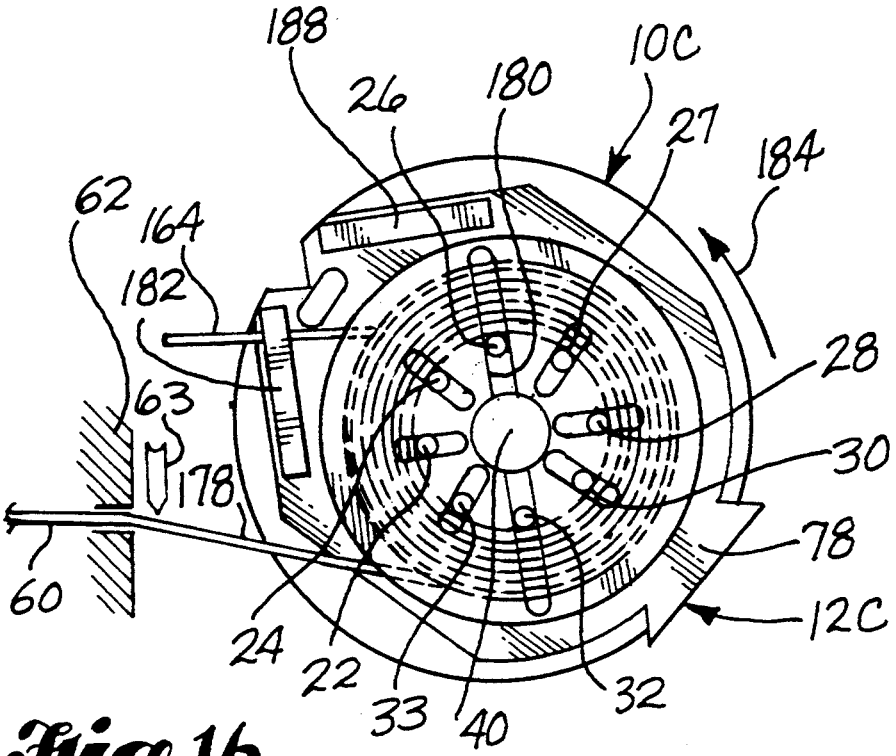
FIG. 16 is a frontal view like FIG. 15.

Reference is now made to FIGS. 15–18. In FIG. 15, the leading end 61 of the wire is shown being delivered from feed station 62 into the first clamp 182 of reel 12C. The wire is wound in counter-clockwise rotation as shown by arrow 184 until the aft end of the segment is reached. FIG. 16 is illustrative of the final winding position.

Figure 17:
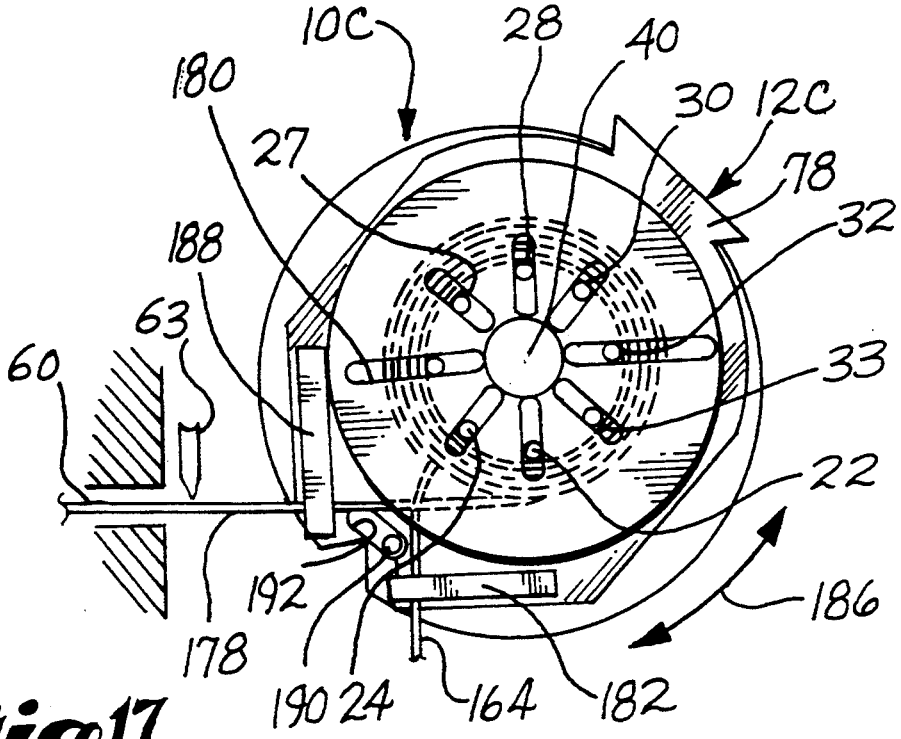
FIG. 17 is still another frontal view like FIGS. 15 and 16.
Figure 18:
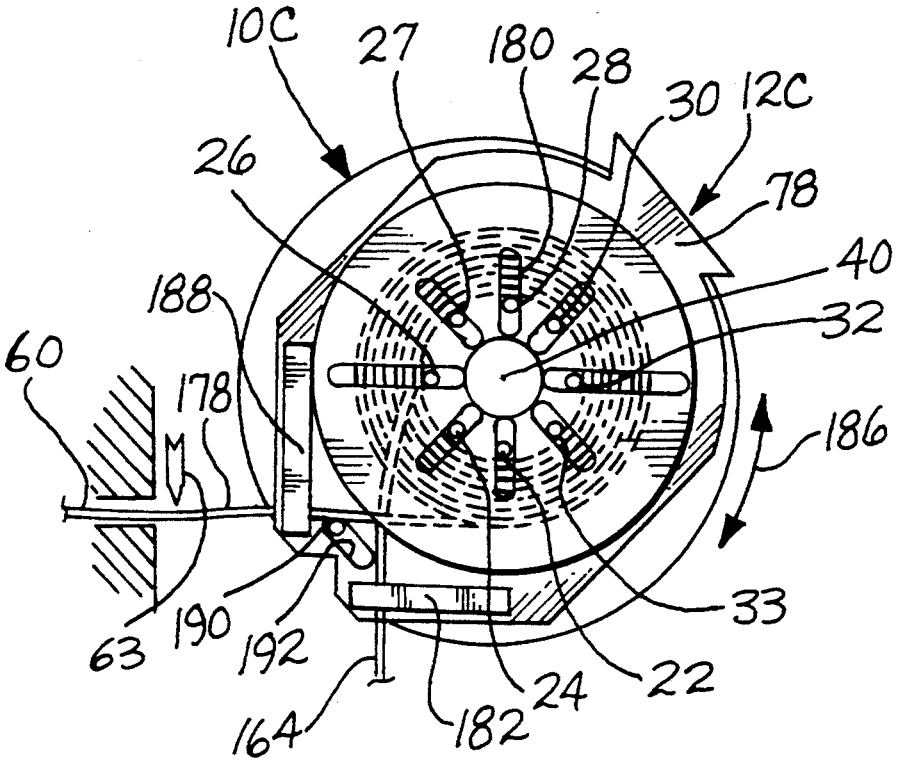
FIG. 18 is still another frontal view like FIGS. 15–17.

When winding stops, the pins 22, 24, 26, 27, 28, 30, 32, and 33 are released and allowed to move radially inwardly toward the center point 40 of the hub when under pressures of the tightening wire. This is shown in FIG. 17. Movement of the pins in this manner creates slack in the coil about the pins while maintaining a certain amount of tension in the wire, and enables further rotation in one direction or the other, as shown by arrow 186, without taking further wire from the feed station 62.

In the embodiment shown in FIGS. 15–18, it is conceivable that the pin hub 10C could or would be rotated in both directions in order to capture the aft end 178 of the wire with the second clamp 188 on the reel. It is possible to supply the pin hub with an extendible alignment pin 190 (see FIGS. 17 and 18) that assists the second clamp 188 in gripping the aft end 178 of the segment. In such case, the reel 12C would be rotated so that the second clamp 188 is aligned with the wire as it exits from the feed station 62. Then, the alignment pin 190 is extended through a slot 192 in the reel 12C. This is followed by rotating the pin through the slot, thereby forcing the wire up into clamp 188 to be gripped thereby.

In the embodiment shown in FIGS. 15–18, it may be possible to preset the diameter or diametrical arrangement of the pins 22, 24, 26, 27, 28, 30, 32, 33 to a diameter that allows maximum usage of the volume between the pin hub 10C and an inner, fixed hub 194 on the reel 12.

Referring again to FIG. 11, the reel clamps 182, 188 are driven by actuators 196, 198 carried by the pin hub. Both the pin hub embodiment shown in FIG. 1 and the embodiment shown in FIGS. 11 and 15–18 would utilize similar actuators 196, 198. It should be further noted that the pin hub shown in FIGS. 11 and 15–18 has two pin members 27, 33 more than the other embodiment. The number of pin members used may vary, although it is probably important to have a sufficient number in order to define a fairly continuous winding circle 36 (see FIG. 2) within any given reel 12.

In summary, the pin hub 10 described above provides the following advantages: First, it enables a simplified design for the large number of reels that will be required in order to handle the large quantity of wire segments anticipated. Second, it eliminates the "winding hub" function of most reels, and places such function with a single pin hub. In other words, the pins 22, 24, 26, 28, 30, 32 function as an outer winding hub and bear the brunt of tension and force caused during the winding process, instead of requiring individual reels to bear such force. Lastly, the pins make it easier to maintain wire tension and control of the winding process, especially during capture of the aft end of the wire segment by the reel.

The pin hub as described above is presently under further development as of the time this document was filed with the U.S. Patent Office. Therefore, it is to be understood that there may be many subsequent developments and improvements to the pin hub as disclosed here. It is not intended, therefore, that the preceding description be viewed in the limiting sense. Instead, the invention is to be limited solely by the patent claim or claims which follow, wherein such claims are to be interpreted in accordance with the well-established doctrines of patent claim interpretation.

What is claimed is:

1. Apparatus for winding wire segments onto wire reels, comprising the combination of:

a plurality of wire reels; each said reel having opposite flanges; said flanges having connected together center portions, axially spaced apart radially outer portions, and a plurality of circumferentially spaced openings extending through said outer portions and one of said flanges including mounting portions;

a drive mechanism; and a hub member mounted on said drive mechanism to be rotated thereby about a drive axis; said hub member having a forward portion with engagement portions configured to engage said mounting portions to mount one of said reels to said forward portion, and a plurality of pin members with end portions that are extendible and retractable relative to said forward portion between a retracted position in which said pin members are positioned axially rearwardly of a forward surface of said forward portion to permit mounting of said reel onto said forward portion by engagement of said mounting portions by said engagement portions and removal of said reel with a wire segment wound thereon from said forward portion by disengagement of said mounting portions and said engagement portions, and an extended position in which said end portions project forwardly from said forward portion to extend through said openings in said flanges of said reel and define a winding space between said outer portions of said flanges.

2. The combination of claim 1, wherein said plurality of pin members are arranged in a circular pattern.

3. The combination of claim 2, wherein each one of said plurality of pin members has an outer radial surface portion that is congruent with a circular arc defined by said circular pattern.

4. The combination of claim 3, wherein said end portion of each pin member has a tapered region.

5. The combination of claim 1, wherein said hub member further has a rearward portion to which all of said pin members are fixedly connected; both of said forward portion and said rearward portion of said hub member being simultaneously drivable about said drive axis, said rearward portion being reciprocatably movable relative to said forward portion along said axis for extending and retracting said pin members, said forward portion having a plurality of pin openings extending therethrough, and said end portions of said pin members being received within said pin openings when said pin members are in said retracted position.

6. The combination of claim 5, wherein said plurality of pin members are arranged in a circular pattern.

7. The combination of claim 6, wherein each one of said plurality of pin members has an outer radial surface portion that is congruent with a circular arc defined by said circular pattern.

8. The combination of claim 7, wherein said end portion of each pin member has a tapered region.

* * * * *

UNITED STATES PATENT AND TRADEMARK OFFICE

CERTIFICATE OF CORRECTION

PATENT NO. : 5,341,998

DATED : August 30, 1994

INVENTOR(S) : Dan A. Cross

It is certified that error appears in the above-indentified patent and that said Letters Patent is hereby corrected as shown below:

Column 5, line 6, "crosssection" should be --cross-section--.

Column 5, line 61, "feeler" should be --reeler--.

Column 10, line 57, "tin" should be --pin--.

Claim 1, column 13, lines 35 and 36, "portions" should be --portions;--.

Signed and Sealed this

Twenty-second Day of August, 1995

*Attest:*

Bruce Lehman

BRUCE LEHMAN

*Attesting Officer*

*Commissioner of Patents and Trademarks*